United States Patent [19]

Gabryszewski

[11] Patent Number: 4,661,688

[45] Date of Patent: Apr. 28, 1987

[54] BULK MELTER PLATEN ASSEMBLY

[75] Inventor: Gregory J. Gabryszewski, Lawrenceville, Ga.

[73] Assignee: Nordson Corporation, Amherst, Ohio

[21] Appl. No.: 802,538

[22] Filed: Nov. 27, 1985

[51] Int. Cl.[4] ..... F27B 14/06

[52] U.S. Cl. ..... 219/421; 222/146.5; 222/259; 222/405

[58] Field of Search ..... 219/421, 420, 422, 423; 222/146.2, 146.5, 381, 405, 256–262, 326

[56] References Cited

U.S. PATENT DOCUMENTS

| | | | |
|---|---|---|---|
| 1,720,871 | 7/1929 | Zerk | 222/257 |
| 1,729,985 | 10/1929 | Carr | 222/256 |
| 2,630,248 | 3/1953 | Hinz | 222/258 |
| 2,941,854 | 6/1960 | Jernander | 222/256 |
| 3,282,469 | 11/1966 | Skonberg | 222/260 |
| 3,752,367 | 8/1973 | Sundholm | 222/260 |
| 3,976,229 | 8/1976 | Jackson | 219/421 |
| 3,982,669 | 9/1976 | Moore | 219/421 |
| 4,073,409 | 2/1978 | Gardner et al. | 222/260 |
| 4,083,428 | 4/1978 | Ness | 222/326 |
| 4,090,640 | 5/1978 | Smith et al. | 222/52 |
| 4,195,755 | 4/1980 | Slautterback | 219/421 |
| 4,227,069 | 10/1980 | Gardner et al. | 219/421 |

*Primary Examiner*—E. A. Goldberg
*Assistant Examiner*—Teresa J. Walberg
*Attorney, Agent, or Firm*—Wood, Herron & Evans

[57] ABSTRACT

Apparatus for melting and pumping molten liquid material from a drum of material which is solid at room temperature and which includes a platen assembly having a top platen and a lower heating platen suspended from the top platen but movable vertically relative thereto. A flexible, expansible sealing element extends between the peripheral edges of the top platen and the lower heating platen so that when the platen assembly is lowered into the open top of a drum of solid material and contacts the top of the solid material, subsequent downward movement of the top platen is operable to move the top platen downwardly toward the heating platen and cause the expansible sealing element to expand radially outward into contact with the interior surface of the drum. When the platen assembly is lifted from the drum, the top platen moves away from the lower heating platen and thereby contracts the diameter of the expansible element so as to move it out of contact with the interior surface of the drum.

14 Claims, 4 Drawing Figures

BULK MELTER PLATEN ASSEMBLY

This invention relates to bulk melting and dispensing apparatus for use with meltable thermoplastic materials, and more particularly, to an improved heating platen assembly for use in such bulk melters.

Heat meltable thermoplastic materials, such as sealants and adhesives, when used in large quantities, are generally packaged and shipped in bulk and usually in large drums. The material is packaged while hot and in liquid form and then hardens upon cooling. To permit use of such materials when packaged in drums, it is necessary to heat the material sufficiently to produce a liquid state wherein the material may be readily dispensed from the drum. Usually, the entire contents of the drum are not used at once, and many thermoplastic heat meltable materials are adversely affected due to degradation if they are sequentially heated to a molten state or maintained in a molten state for a prolonged period of time. Accordingly, dispensing apparatus has been developed and is in commercial use for heating and dispensing only that material adjacent the upper surface of the shipping contaner such that only a relatively small portion of the packaged material adjacent the top of the package is maintained in a molten state. U.S. Pat. Nos. 4,073,409 and 4,227,069 typify this type of bulk melting and dispensing apparatus.

In general, bulk melting and dispensing apparatus comprises a platen assembly, which when lowered into the open top of a drum of thermoplastic material, is operative to melt the top surface of that material so as to enable it to be pumped as a liquid from the drum. That platen assembly generally comprises a circular plate from which there is suspended a heated platen. The top plate generally has a peripheral seal engageable with the interior surface of the drum so as to prevent molten thermoplastic material from being forced upwardly over the top of the circular plate as the platen assembly is urged downwardly into the molten thermoplastic material. The platen assembly also generally carries a pump which is operative to pump the molten material from beneath the platen assembly.

The seal between the drum and the platen assembly of bulk melters of the type described hereinabove is critical to the successful operation of the melter. If that seal is imperfect, the molten material will leak past this seal to the top side of the platen assembly from whence the molten material cannot be pumped and therefore becomes waste. Furthermore, that leakage material contributes to making a mess of the complete platen assembly when it subsequently hardens on the top side of the assembly.

It has therefore been an objective of this invention to provide an improved seal between a platen assembly of a bulk melting and dispensing apparatus and the drum within which that platen assembly is lowered to pump molten material from the drum.

Still another objective of this invention has been to provide an improved seal for bulk melter platen assembly which will accommodate variations and imperfections in the drum and still effect a seal between the platen assembly and the interior surface of the drum.

The platen assembly of this invention which accomplishes these objectives comprises a top plate from which there is suspended a heating platen and a flexible, expansible sealing element which extends between the periphery of the top platen and the heating platen. The two platens are spring biased apart, but are free to move toward each other and in the process, to effect expansion of the flexible, expansible seal which extends between the two. Internally of the flexible seal in the chamber between the top plate and the heated platen there is a pump which is operative to pump molten material from beneath the heated platen. As the platen assembly is lowered into a drum of hot melt adhesive, the lower heated platen is operative to come into contact with and melt the top surface of the solid thermoplastic material contained within the drum. Continued lowering of the platen assembly into the drum causes the top plate to move downwardly relative to the lower heated platen and thereby effect expansion of the flexible, expansible sealing element which extends between the two. Molten thermoplastic material located beneath the heated platen is then pumped therefrom as the two platens continue to move downwardly into the drum. The flexible, expansible seal moves downwardly with the two platens as the two are urged either by gravity or by fluid motors into the drum.

The primary advantage of this platen assembly is that it effectively maintains a seal with the interior surface of the drum as the platen assembly is lowered into the drum. It is automatically expansible to accommodate variations in the diameter of the drum and out-of-round configurations of that interior surface.

These and other objects of this invention will be more readily apparent from the following description of the drawings in which.

Figure 1:
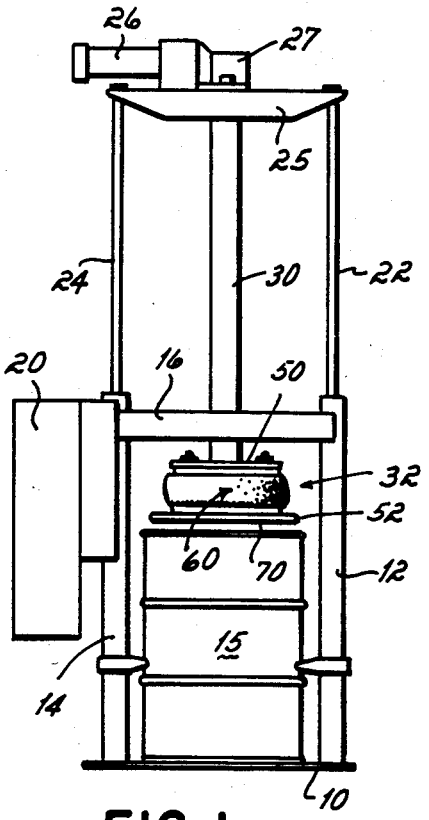
FIG. 1 is a side elevational view of a bulk melting and dispensing apparatus incorporating the invention of this application.

A bulk melting and dispensing apparatus incorporating the novel platen assembly of this invention includes a base plate 10 on which is supported a plurality of uprights, including a pair of upright, support cylinders 12 and 14. The base supports a barrel 15 of thermoplastic material to be dispensed by the apparatus of this invention.

The cylinders 12 and 14 are connected at their upper ends to a transverse support 16. In the illustrated embodiment, a control box 20 is supported between the base 10 and support 16.

A pair of cylinder rods 22 and 24 extends upwardly from the cylinders 12 and 14, respectively. The rods are joined and connected at their tops by a cross head 25. The cross head 25 also supports a pump drive motor 26 and a right angle drive gear box 27.

The cross head 25 further supports a depending tube 30. A platen assembly 32 is carried by the tube 30. This platen assembly is lowered into the open top of the drum 15 supported upon the base 10 upon admission of air into the cylinders 12 and 14. Admission of that air causes the rods 22 and 24 to extend and lift the cross head 25 and the associated structure supported thereon to an elevated or raised position, or alternatively, if air under pressure is supplied to the opposite ends of the cylinders 12 and 14, to cause the platen assembly 32 to be lowered into the barrel with a predetermined force or pressure against thermoplastic material contained in the barrel 15.

The platen assembly 32 comprises an upper plate 50 fixedly attached to the tube 30. This plate is circular in configuration and slightly smaller in diameter than the internal diameter of the drum 15 into which the platen assembly is to be inserted.

Suspended from the upper plate there is a heating platen or plate 52. This heating platen 52 is also circular and of approximately the same diameter as the upper plate. It is suspended from the upper plate by spacer studs 56 which extend upwardly through holes in the upper plate 50 and are slidable therein. Nuts 57 threaded onto the upper ends of the studs 56 determine the spacing between the top plate 50 and the heated platen 52. In the preferred embodiment there are compression springs 58 surrounding the spacer studs 56. The springs bias the heating platen downwardly relative to the upper platen.

Extending between and surrounding the upper platen 50 and the heated platen 52 there is a flexible, expansible seal 60. This seal 60 is annular in configuration and has an upper edge 61 secured to the periphery of the top platen 50 and a lower edge 64 secured to the periphery of the heated platen 52. In the preferred embodiment of the invention, the upper edge 61 of the seal 60 is received within an annular groove 62 of the upper platen 50 and secured thereto by a conventional adjustable screw band clamp 63. Similarly, the bottom edge 64 of the flexible seal 60 is secured within a annular groove or channel 66 of the lower heated platen 52 by a surrounding adjustable screw band clamp 68.

Figure 3:
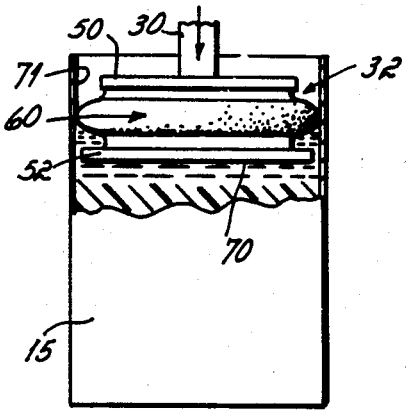
FIG. 3 is a partially diagrammatic side elevational view of the bulk melting and dispensing apparatus of this invention illustrating the expansion of the seal of the apparatus during lowering of the plate assembly into the molten thermoplastic material.
Figure 4:
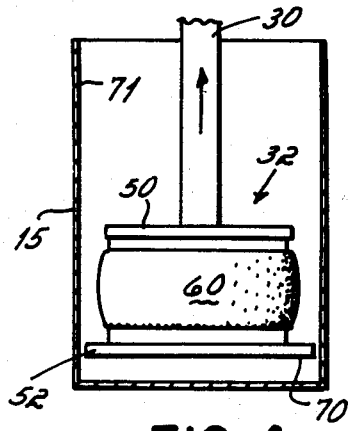
FIG. 4 is a view similar to FIG. 3, but illustrating contraction of the seal during the lifting of the platen assembly from the thermoplastic material containing drum.
Figure 2:
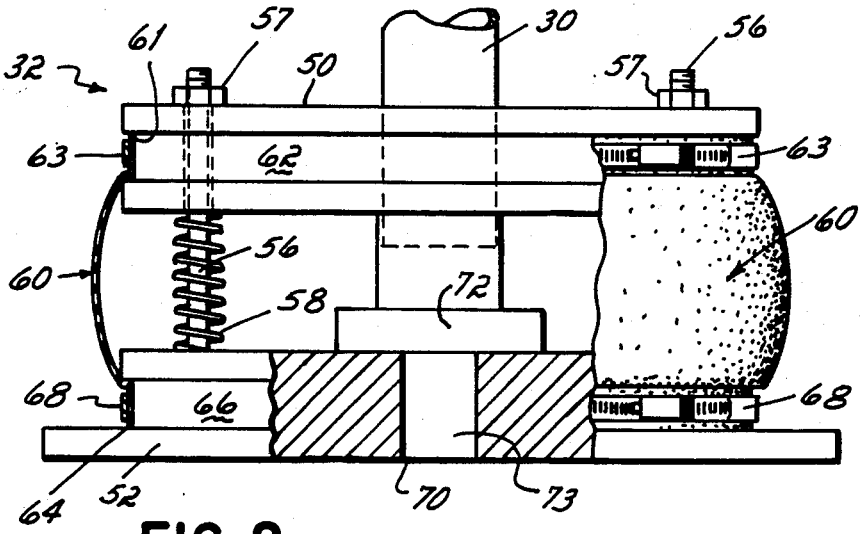
FIG. 2 is an elevational view, partially in cross-sectional, of the platen assembly for the bulk melter of FIG. 1 incorporating the invention of this application.

In the use of the platen assembly, the assembly is lowered into a drum 15 until the bottom surface 70 of the lower heated platen 52 engages the top surface of the solid thermoplastic material contained within the drum. Upon engagement of the bottom surface of the heated platen 52 with the top surface of the thermoplastic material, the upper platen continues to move downwardly toward the lower heated platen 52, thereby effecting radial expansion of the flexible seal 60 as is best illustrated in FIG. 3. That expansion continues until the outer peripheral surface of the flexible seal engages the inner surface 71 of the drum. This outer peripheral surface of the seal will remain engaged with the drum as the complete platen assembly 32, including the upper platen 50 and heating platen 52, is lowered into the drum 15. As the platen assembly 32 is lowered into the molten thermoplastic material, the topmost portion of the thermoplastic material is heated and flows in the molten state through a hole or holes 73 in plate 52 into and through a conventional pump 72 secured to the topside of the lower platen 52. After all of the solid material contained within the drum 15 has been melted and pumped therefrom, the tube 30 and the attached upper plate 50 are raised, thereby causing the upper plate 50 to move away from the lower heated platen 52. As best illustrated in FIG. 4, movement of the upper platen away from the lower heating platen reduces the diameter of the flexible seal 60 and thereby disengages the seal from engagement with the inner surface 71 of the drum 15. In this contracted position of the expansible seal and out of contact with the inner surface of the drum, the complete platen assembly 32 is lifted from the drum as illustrated in FIG. 4.

The primary advantage of the platen assembly described hereinabove is that it includes an expansible seal which expands and automatically forms a seal with the interior surface of the drum as the platen assembly is lowered into the drum. This seal is effectively maintained irrespective of whether the drum varies in diameter or whether the drum has noncircular imperfections therein or is out of round. When the platen assembly is lifted from the drum, the seal automatically contracts and disengages the inner surface of the drum. This seal is therefore effective to prevent molten thermoplastic material from escaping between the seal and the drum and becoming waste or creating a mess on the top side of the seal and the upper plate 50 as the platen assembly is lowered into the drum. It also has the advantage of automatically being collapsed and disengaged with the inside wall of the drum when the platen assembly is lifted and removed from the drum.

While I have described only a single preferred embodiment of my invention, persons skilled in this art will appreciate changes and modifications which may be made without departing from the spirit of my invention. Therefore, I do not intend to be limited except by the scope of the following appended claims:

I claim:

1. Apparatus for melting and pumping molten liquid material from a drum of material which is solid at room temperature, which apparatus comprises:

a platen assembly comprising a top platen and a lower heating platen, said top platen being substantially circular in peripheral configuration and located in a horizontal plane, said heating platen being located beneath said top platen, said heating platen being substantially circular in peripheral configuration and of slightly less diameter than the interior of said drum, means supporting said heating platen for vertical movement toward and away from said top platen, a flexible expansible element extended between and secured to peripheral portions of said top platen and said heating platen, means for lowering said platen assembly into the open top of a drum of solid material until said heating platen contacts the top of said solid material, said contact of said heating platen with said solid material and subsequent downward movement of said top platen being operable to move said top platen downwardly toward said heating platen so as to cause said expansible element to expand radially outwardly into contact with the interior surface of said drum, and means for lifting said platen assembly from said drum, said lifting of said platen assembly being operable to move said top platen away from said heating platen and thereby contract the diameter of said expansible element so as to move it out of contact with the interior surface of said drum.

2. The apparatus of claim 1 which further includes a pump mounted upon said assembly and operable to pump molten material from beneath said expansible element.

3. The apparatus of claim 1 wherein said heating platen is suspended from said top platen.

4. The apparatus of claim 1 wherein said heating platen is suspended from said top platen by at least two supporting studs, said studs being fixed to and extending upwardly through bores in said top platen, and means secured to the upper ends of said studs and engageable with a top surface of said top platen to limit the extent to which said heating platen may be moved away from said top platen.

5. The apparatus of claim 4 wherein a compressible spring surrounds each of said supporting studs, each of said compressible springs being engageable with a bottom surface of said top platen and a top surface of said heating platen.

6. A platen assembly for melting and pumping molten liquid material from a drum of material which is solid at room temperature, which assembly comprises:

a top platen which is substantially circular in peripheral configuration, said top platen being located in a horizontal plane, a heating platen located beneath said top platen, said heating platen being substantially circular in peripheral configuration and of slightly less diameter than the interior of said drum, means supporting said heating platen for vertical movement toward and away from said top platen, and a flexible, expansible element extending between and secured to peripheral portions of said top platen and said heating platen, said flexible, expansible element when in tension being of a first diameter and when compressed being of a second substantially larger diameter, whereby said assembly is adapted to be lowered into the open top of a drum of solid material until said heating platen contacts the top of said solid material, said contact of said heating platen with said solid material and subsequent downward movement of said top platen being operable to move said top platen downwardly said heating platen so as to cause said expansible element to expand radially outwardly into contact with the interior surface of said drum.

7. The platen assembly of claim 6 which further includes a pump mounted upon said assembly and operable to pump molten material from beneath said expansible element.

8. The apparatus of claim 6 wherein said heating platen is suspended from said top platen.

9. The apparatus of claim 6 wherein said heating platen is suspended from said top platen by at least two supporting studs, said studs being fixed to and extending upwardly from said heating platen, said studs extending upwardly through bores in said top platen, and means secured to the upper ends of said studs and engageable with a top surface of said top platen to limit the extent to which said heating platen may be moved away from said top platen.

10. The apparatus of claim 9 wherein a compressible spring surrounds each of said supporting studs, each of said compressible springs being engageable with a bottom surface of said top platen and a top surface of said heating platen.

11. A platen assembly for melting and pumping molten liquid material from a drum of material which is solid at room temperature, which assembly comprises:

a top platen which is substantially the same peripheral configuration as the open top of said drum, said top platen being located in horizontal plane, a heating platen located beneath said top platen, said heating platen being of substantially the same peripheral configuration as said top platen, means suspending said heating platen from said top platen for vertical movement toward and away from said top platen, and a flexible expansible sealing element extending between and attached at the top to the peripheral edge of said top platen and at the bottom to the peripheral edge of said heating platen such that said sealing element expands when said top platen is moved toward said heating platen and contracts when said top platen is moved away from said heating platen.

12. The platen assembly of claim 11 which further includes a pump mounted upon said assembly and operable to pump molten material from beneath said expansible sealing element.

13. The apparatus of claim 11 wherein said heating platen is suspended from said top platen by at least two supporting studs, said studs being fixed to and extending upwardly from said heating platen, said studs extending upwardly through bores in said top platen, means secured to the upper ends of said studs and engageable with a top surface of said top platen to limit the extent to which said heating platen may be moved away from said top platen.

14. The apparatus of claim 13 wherein a compressible spring surrounds each of said supporting studs, each of said compressible springs being engageable with a bottom surface of said top platen and a top surface of said heating platen.

* * * * *

UNITED STATES PATENT AND TRADEMARK OFFICE

CERTIFICATE OF CORRECTION

PATENT NO. : 4,661,688

DATED : April 28, 1987

INVENTOR(S) : Gregory J. Gabryszewski

It is certified that error appears in the above-identified patent and that said Letters Patent is hereby corrected as shown below:

Column 1, line 24, change "contaner" to --container--.

Column 4, line 41, change "extended" to --extending--.

Column 5, line 36, after "downwardly" insert --toward--.

Signed and Sealed this

Ninth Day of February, 1988

*Attest:*

DONALD J. QUIGG

*Attesting Officer*

*Commissioner of Patents and Trademarks*